US006315396B1

(12) United States Patent
Ozaki et al.

(10) Patent No.: US 6,315,396 B1
(45) **Date of Patent: *Nov. 13, 2001**

(54) INK JET RECORDING HEAD AND SUBSTRATE

(75) Inventors: Teruo Ozaki, Yokohama (JP); Toshihiro Mori, Irvine, CA (US); Masahiko Kubota, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/874,582

(22) Filed: Jun. 13, 1997

(30) Foreign Application Priority Data

Jun. 14, 1996 (JP) ..... 8-154115

(51) Int. Cl.[7] ..... B41J 2/05
(52) U.S. Cl. ..... 347/60
(58) Field of Search ..... 347/59, 60, 61, 347/62, 63, 56, 17, 48

(56) References Cited

U.S. PATENT DOCUMENTS

| | | | | |
|---|---|---|---|---|
| 4,532,530 | * | 7/1985 | Hawkins | 347/62 |
| 4,723,129 | | 2/1988 | Endo et al. | 347/56 |
| 4,740,796 | | 4/1988 | Endo et al. | 347/56 |
| 4,980,702 | * | 12/1990 | Kneezel et al. | 347/17 |
| 5,053,787 | * | 10/1991 | Terasawa et al. | 347/56 |
| 5,194,877 | * | 3/1993 | Lam et al. | 347/63 |
| 5,517,224 | * | 5/1996 | Kaizu et al. | 347/59 |
| 5,559,535 | * | 9/1996 | Otsuka et al. | 347/14 |

FOREIGN PATENT DOCUMENTS

| | | | | |
|---|---|---|---|---|
| 2169856 | * | 7/1986 | (DE) | 347/60 |
| 57-072868 | | 5/1982 | (JP) . | |
| 247052 | * | 10/1988 | (JP) | 347/60 |
| 3-005151 | | 1/1991 | (JP) . | |
| 3343254 | | 2/1991 | (JP) . | |
| 3-146349 | | 6/1991 | (JP) . | |

* cited by examiner

*Primary Examiner*—John E. Barlow, Jr.
*Assistant Examiner*—Michael Brooke
(74) *Attorney, Agent, or Firm*—Fitzpatrick, Cella, Harper & Scinto

(57) ABSTRACT

There is disclosed a substrate for use in an ink jet recording head, comprising on a base member an insulating film comprising an insulating material, a bubble-generating heater for generating heat required for bubble generation in ink, and a preheating heater for generating heat to be applied to a recording head for effecting recording on a recording medium, wherein the preheating heater is provided in a layer lower than that of the bubble-generating heater with interposition of the insulating film.

9 Claims, 8 Drawing Sheets

INK JET RECORDING HEAD AND SUBSTRATE

BACKGROUND OF THE INVENTION

1. Field of the Invention

The present invention relates to a substrate for an ink jet recording head, particularly to a substrate for use in an ink jet recording head, which comprises a heater for generating bubbles in ink and an auxiliary heater for preheating the ink, the heaters being formed on the same base member.

2. Related Background Art

The ink jet recording system disclosed in U.S. Pat. Nos. 4,723,129 or 4,740,796 is recently attracting particular attention because it is capable of carrying out recording of high-precision and high image quality with a high speed and a high density, and is suitable for color image formation and for compaction.

In the above-mentioned ink jet recording system, the recording head in which bubbles are generated in ink by utilizing thermal energy to discharge the ink onto a recording medium, generally has a configuration in which heat-generating resistance members for generating bubbles in the ink and wirings for electrical connection are formed on the same base member to provide the substrate for the ink jet recording head and then nozzles for discharging the ink are formed thereon.

Further, recently there have been made developments to incorporate many functions into such substrate for the ink jet recording head or to increase the density thereof.

For example, Japanese Patent Application Laid-Open No. 57-72868 discloses a substrate for an ink jet recording head, incorporating functional elements for driving the head.

Also, Japanese Patent Application Laid-Open No. 3-5151 discloses that in a substrate for an ink jet recording head, a bubble-generating heater and an ink-preheating heater are formed in the same layer by using the same material, and that heating of the substrate for the head by such preheating heater prevents the deterioration of the discharge characteristics at a low-temperature situation.

In relation to the heating method by such preheating heater, a method for controlling ink viscosity according to gradation signals is disclosed in Japanese Patent Application Laid-Open No. 3-146349, and a method for maintaining a recording head at a constant temperature during recording operation is disclosed in Japanese Patent Application Laid-Open No. 3-43254.

FIG. 9 shows a configuration of a conventional substrate for an ink jet recording head, comprising a preheating heater.

As shown in FIG. 9, this conventional example is composed of a bubble-generating heater 9003 formed by a heat-generating resistance member (not shown) for generating heat required for bubble generation in the ink, wirings 9004 for supplying an electrical current from a power supply (not shown) to the heat-generating resistance member, and a preheating heater 9005 formed by a heat-generating resistance member for generating additional heat to be applied to the recording head portion.

In general, the substrate for the ink jet recording head is formed by repetition of the steps of carrying out film formation of a resistance member, a wiring metal and an insulating film, for example, on a silicon substrate and then executing patterning by photolithography. Also, in case of forming functional elements such as integrated circuits at the same time on the same base member, there is repeatedly executed the steps commonly employed in the semiconductor device manufacture.

In such operation, in order to reduce the production cost by increasing the number of the substrates for the ink jet recording head per one starting silicon substrate, it is required to reduce, as far as possible, the size of the substrate for the ink jet recording head. For this purpose, it is required to reduce the size of the bubble-generating heater and of the functional elements such as integrated circuits, and to improve the efficiency of arrangement of the wirings.

However, such conventional substrate for the ink jet recording head has the following problems, because the bubble-generating heater and the preheating heater are formed in the same plane.

(1) In case a higher level of integration is intended by arranging a plurality of the bubblegenerating heaters, the preheating heaters cannot be positioned close to the bubble-generating heaters because power-supplying wirings are present in the vicinity of the bubble-generating heaters. As the result, the substrate becomes inevitably large.

(2) At a low temperature condition, the amount of heat for preheating has to be increased. In such case, there is required a relatively large preheating heater in order not to achieve the preheating without bubble generation. As the result, the substrate becomes inevitably large.

(3) In case the bubble-generating heaters are arranged at a high level of integration as in the above (1), the preheating heaters cannot be positioned behind such bubble-generating heaters or in the area of the integrated circuits, but have to be positioned only at the side of thus arrayed bubble-generating heaters. As the result, the substrate becomes large in size in the direction of array of the bubble-generating heaters.

SUMMARY OF THE INVENTION

In consideration of the problems of the prior art as described above, an object of the present invention is to provide a substrate for an ink jet recording head, which is capable of reducing the production cost by the reduction of size of the substrate.

To attain the above object, according to a first aspect of the present invention, a substrate for use in an ink jet recording head comprises on a base member an insulating film comprising an insulating material;

a bubble-generating heater for generating heat required for bubble generation in ink; and a preheating heater for generating heat to be applied to a recording head for effecting recording on a recording medium;

wherein the preheating heater is provided in a layer lower than that of the bubble-generating heater with interposition of the insulating film.

In a preferred embodiment of the present invention, the above preheating heater is formed by using a resistance member different in resistive material from that of the bubble-generating heater. In another preferred embodiment of the present invention, the above preheating heater is formed by using polysilicon.

According to a second aspect of the present invention, a substrate for use in an ink jet recording head comprises on a base member an insulating film comprising an insulating material;

a bubble-generating heater for generating heat required for bubble generation in ink;

a preheating heater for generating heat to be applied to a recording head for effecting recording on a recording medium;

a wiring for supplying electrical current to the bubble-generating heater and the preheating heater; and a transistor portion and a logic portion for controlling the function of the recording head;

wherein the preheating heater is provided in a position different from that of the transistor portion and the logic portion.

In a further preferred embodiment of the present invention, the above preheating heater is provided between the transistor portion and an end portion where the bubble-generating heater is provided, and provided in a layer lower than that of the bubble-generating heater with interposition of the insulating film.

According to a third aspect of the present invention, a substrate for use in an ink jet recording head comprises on a base member an insulating film comprising an insulating material;

a bubble-generating heater for generating heat required for bubble generation in ink;

a preheating heater for generating heat to be applied to a recording head for effecting recording on a recording medium;

a part of an ink flow path for supplying the ink to the recording head;

wherein the preheating heater is provided in a position corresponding to the ink flow path and in a layer lower than that of the bubble-generating heater with interposition of the insulating film.

According to a fourth aspect of the present invention, a substrate for use in an ink jet recording head comprises on a base member an insulating film comprising an insulating material;

a bubble-generating heater for generating heat required for bubble generation in ink;

a preheating heater for generating heat to be applied to a recording head for effecting recording on a recording medium; and a part of a common liquid chamber for containing the ink to be supplied to the recording head;

wherein the preheating heater is provided in a position corresponding to the common liquid chamber and in a layer lower than that of the bubble-generating heater with interposition of the insulating film.

In a still further preferred embodiment of the present invention, an ink jet recording head comprises any one of the substrates as mentioned above and is mounted on a carriage to effect recording on a recording medium.

In the present invention of the above-mentioned configuration, since the preheating heater is provided in a layer lower than that of the bubble-generating heater with interposition of the insulating film, the position of the preheating heater is not limited by the arrangement of the bubble-generating heater and of the wirings connecting thereto.

Also, the preheating heater is formed by using a resistive material different from that of the bubble-generating heater, and the bubble-generating heater is formed from a resistive material capable of generating sufficient energy per unit area for bubble generation in the ink, while the preheating heater is formed from a resistive material capable of generating energy per unit area which does not cause unnecessary bubble generation in the ink.

Also, since the preheating heater is formed by using polysilicon which is used in the formation of integrated circuits, there is not increased the number of layers or steps in the manufacturing process.

Also, since the preheating heater is provided in a position corresponding to the ink flow path, there can be improved the frequency characteristics of ink refilling.

DESCRIPTION OF THE PREFERRED EMBODIMENTS

In the following, the present invention will be described in detail by preferred embodiments thereof, with reference to the attached drawings.

First Embodiment

Figure 1A:
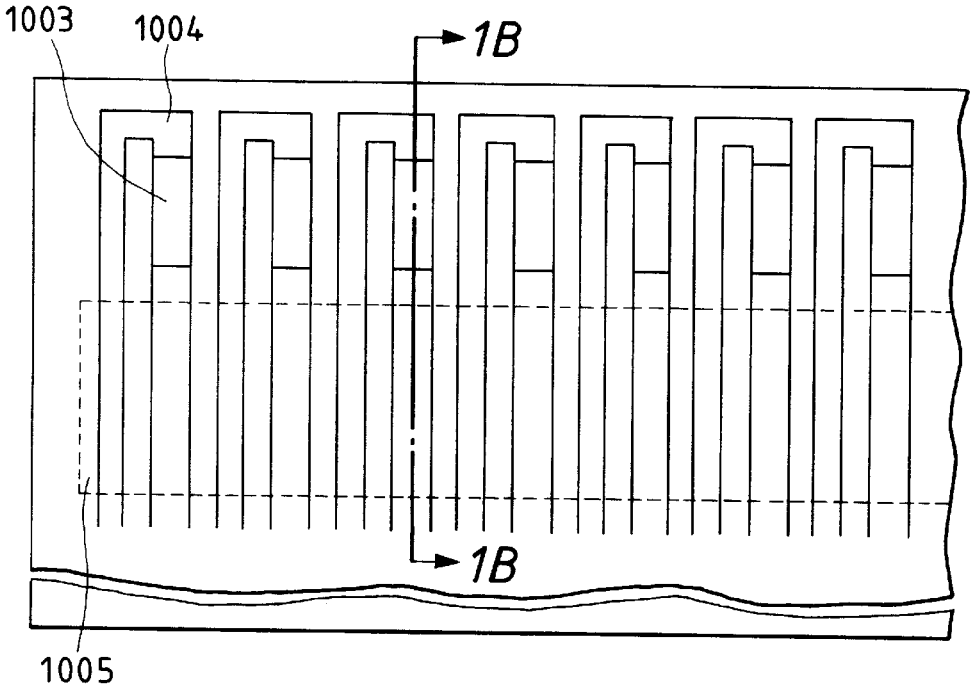
FIG. 1A is a plan view showing a first embodiment of the substrate of the present invention for the ink jet recording head.
Figure 1B:
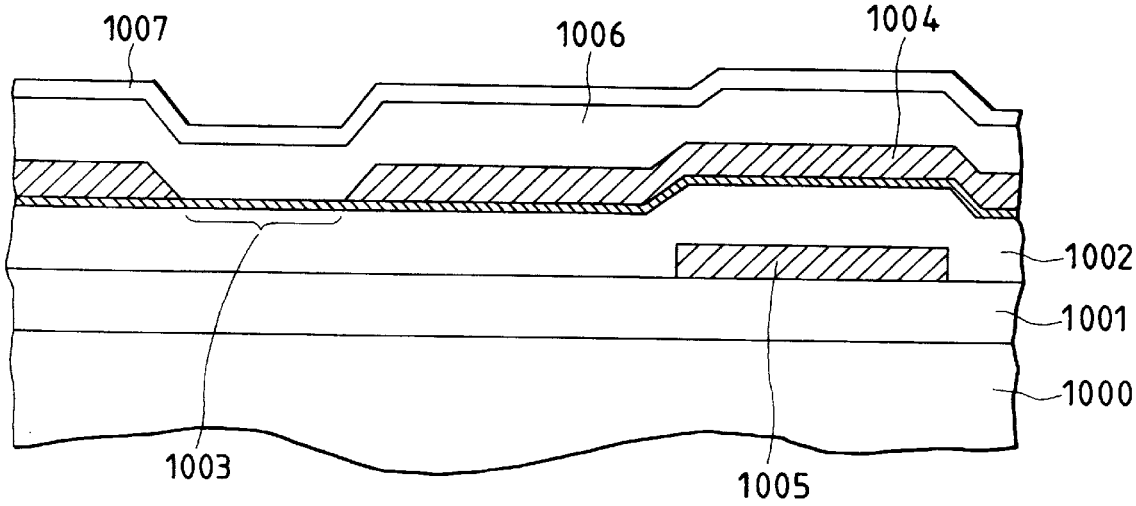
FIG. 1B is a cross-sectional view taken in the line 1B—1B of FIG. 1A.

FIGS. 1A and 1B are respectively a plan view and a cross-sectional view showing a first embodiment of the substrate of the present invention for the ink jet recording head.

In the present embodiment, as shown in FIG. 1B, an $SiO_2$ film 1001, an insulating film 1002, a protective film 1006 and an anticavitation film 1007 are formed on an Si base member 1000 in this order. Between the insulating film 1002 and the protective film 1006, there are provided a plurality of bubble-generating heaters 1003 formed by heat-generating resistance members (not shown) for generating the heat required for bubble generation in the ink and wirings 1004 for supplying electrical current from a power source (not shown) to the heat-generating resistance members. A preheating heater 1005 formed by a heat-generating resistance member for generating heat required for temperature adjustment and discharge adjustment of the recording head portion (not shown) is provided on a part of the $SiO_2$ film 1001 in such a manner as to be separated from the bubble-generating heater 1003 and the wirings 1004 with interposition of the insulating layer 1002.

In the following, there will be explained a manufacturing method of the above-explained substrate for the ink jet recording head.

At first, a single-crystal Si base member 1000 is prepared as the base member. In this example there is employed a P-type base member of a wafer size of 5 inches in diameter, with a thickness of 625 μm, but the wafer size, the thickness and the type (P or N) are not limited to those mentioned above and do not restrict the manufacturing process. Also, the $SiO_2$ base member 1000 may be replaced by another base member, e.g., of $A1_2O_3$, polysilicon, quartz or glass. Also, by suitable selection of the manufacturing equipment, there can be employed a metal such as aluminum or an aluminum alloy as the base member, without limitation in the wafer size or the shape.

Then, the $SiO_2$ base member 1000 is subjected to thermal oxidation for 10 hours at 1200° C. in steam atmosphere to form the $SiO_2$ film 1001 of a thickness of about 1.5 μm. The $SiO_2$ film 1001 may also be replaced by an SiN film, an SiN film containing SiO, or an $A1_2O_3$ film, and, in such case, the film may be formed by sputtering or CVD.

Then, on the $SiO_2$ film 1001, a polysilicon layer is formed by CVD with a thickness of 0.3 μm to 5 μm.

Then, the preheating heater 1005 is prepared by using the polysilicon layer, and, in this operation, phosphor as an impurity is doped into the polysilicon layer by thermal diffusion at 1050° C. to adjust the sheet resistance within a range of 5 Ω to 50 Ω for controlling the level of heating. The phosphor may be doped also by ion implantation instead of thermal diffusion, or simultaneously with the formation of the polysilicon layer by CVD. The position of the preheating heater 1005 is not limited with respect to the position of the bubble-generating heater 1003.

Subsequently, the polysilicon layer is formed into a predetermined size in a predetermined position, by patterning with a photolithographic process. In this example, the polysilicon layer was patterned by dry etching after predetermined portions were covered with a resist by photolithography, and the resist was then removed.

Then, the $SiO_2$ insulating film 1002 is formed by CVD with a thickness of 0.3 μm to 2 μm. The insulating film 1002 serves as an electrically separating layer between the preheating heater 1005 and the wirings 1004 formed in the upper layer, and serves also as a heat-accumulating layer under the bubble-generating heater 1003. The insulating film 1002 may also be, instead of Si02, an $SiO_2$ film doped with phosphor or boron, an SiN film or an SiN film containing SiO. Also, it may be formed by sputtering instead of CVD.

Then, a TaN film of a thickness of 0.01 μm to 0.3 μm constituting the heat-generating resistance member and an Al film of a thickness of 0.1 μm to 2 μm constituting the wirings are successively formed by sputtering. The heat-generating resistance member may also be composed of $HfB_2$, TaAl or polysilicon instead of TaN, and the Al film may also be composed of an Al alloy such as Al—Si or Al—Cu.

Subsequently, the wirings are formed into a predetermined pattern by a photolithographic process. In this example, the patterning was conducted by wet etching after predetermined portions were covered with a resist by photolithography, and the resist was then removed. The electrical connections to the preheating heater 1005 are made by connections to the wirings 1004 exclusive for the preheating heater 1005 in through-holes (not shown) of the insulating film 1002.

The wirings 1004 were patterned by wet etching ith phosphoric acid, but similar patterning is also possible by dry etching.

Then, a TaN film was formed into a predetermined pattern by a photolithographic process to obtain the bubble-generating heater 1003. In this example the pattern was formed by dry etching after predetermined portions were covered with a resist by photolithography, and the resist was then removed.

Then, an SiN film of a thickness of 0.1 μm to 2 μm is formed by CVD as the protective film 1006. The protective film 1006 is not limited to such SiN film but can be composed of any electrically insulating film such as an SiO film, an SiO film containing SiN, an $Al_2O_3$ film or a $Ta_2O_5$ film.

Then, a Ta film of a thickness of 0.1 μm to 1 μm is formed by sputtering as the anticavitation film 1007. The anticavitation film 1007 is not limited to such Ta film but can be composed of any film with high anticavitation property such as of TaN, W, SiC or Cr. It may also be formed by CVD instead of sputtering.

Then, the anticavitation film 1007 and the protective film 1006 were formed in predetermined patterns respectively by dry etching and wet etching with a photolithographic process, and the resist is then removed to obtain the substrate for the ink jet recording head.

In comparison with the conventional substrate with preheating function, the size of the substrate prepared in the above-explained process was reduced by about 20%, with the same of the preheating function of the conventional substrate.

Second Embodiment

Figure 2:
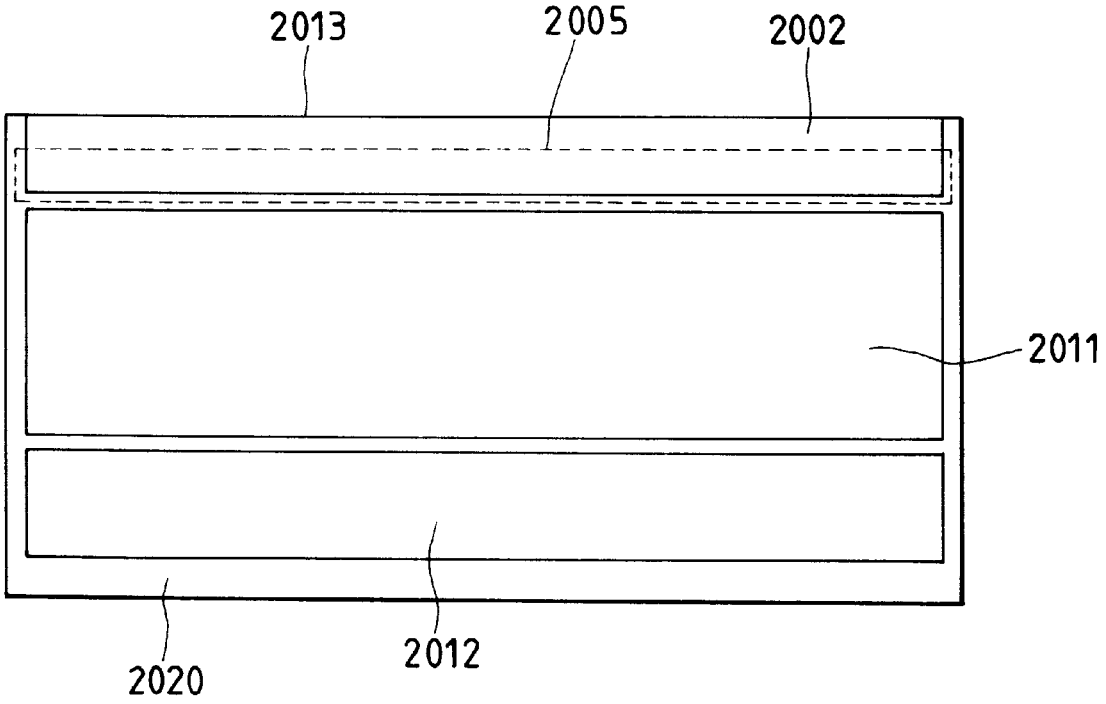
FIG. 2 is a plan view showing a second embodiment of the substrate of the present invention for the ink jet recording head.

FIG. 2 shows a second embodiment of the substrate of the present invention for the ink jet recording head.

In the present embodiment, as shown in FIG. 2, a heater portion 2013 composed of a heat-generating resistance member (not shown) for generating heat required for bubble generation in the ink, a preheating heater 2005 composed of a heat-generating resistance member for generating heat for performing the temperature adjustment and the discharge adjustment of the recording head portion, and an-insulating film 2416 (FIG. 3) for isolating the heater portion 2013 from the preheating heater 2005 are formed on the same base member which also bears a transistor portion 2011 and a logic portion 2012 in an IC portion for the ink jet recording head 2002 are fixed on a substrate 2020.

In the following there will be explained a method of manufacturing the above-explained substrate for the ink jet recording head.

Figure 3:
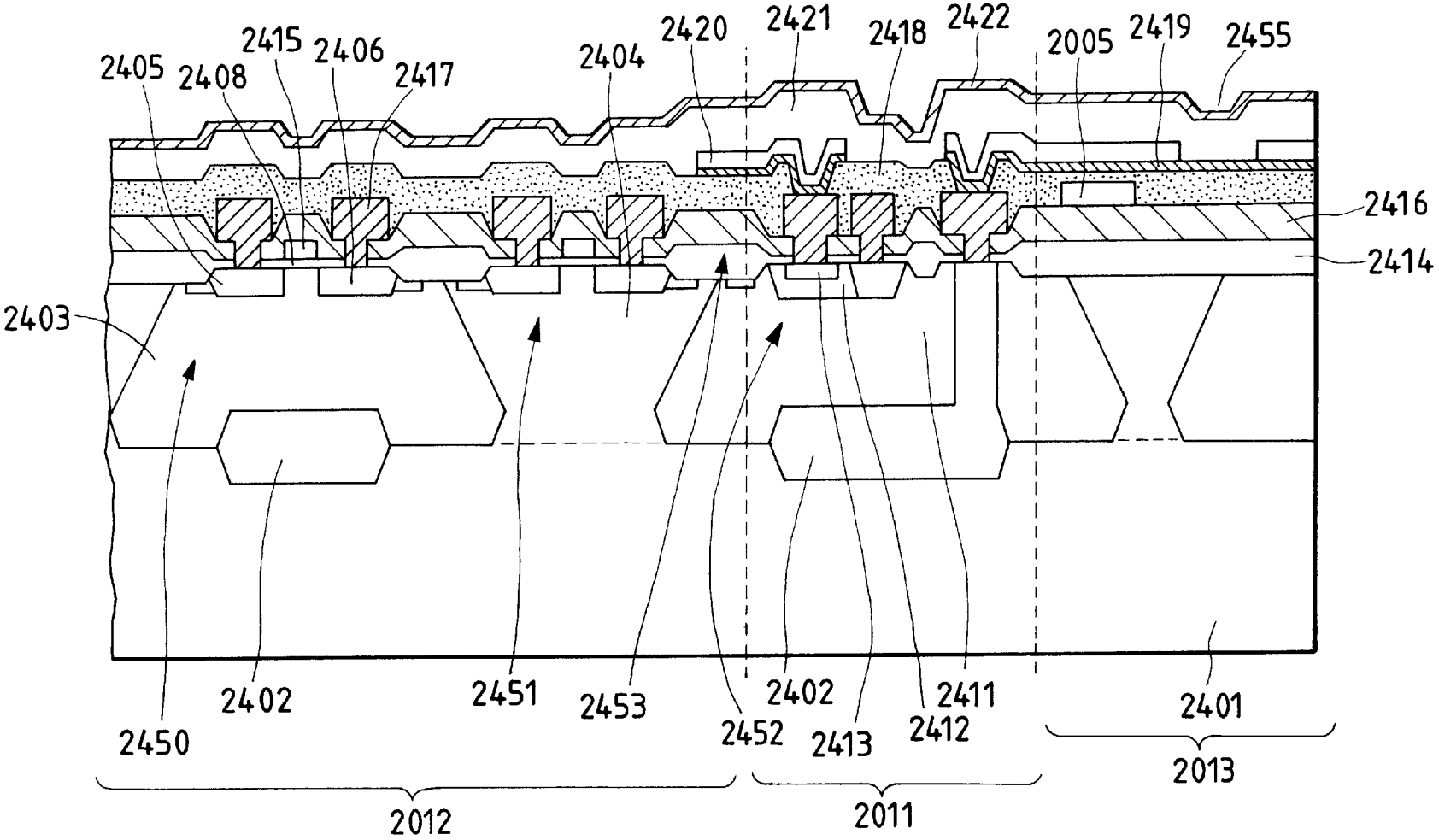
FIG. 3 is a detailed cross-sectional view, at the ink discharge side, of the substrate for the ink jet recording head shown in FIG. 2.
Figure 4:
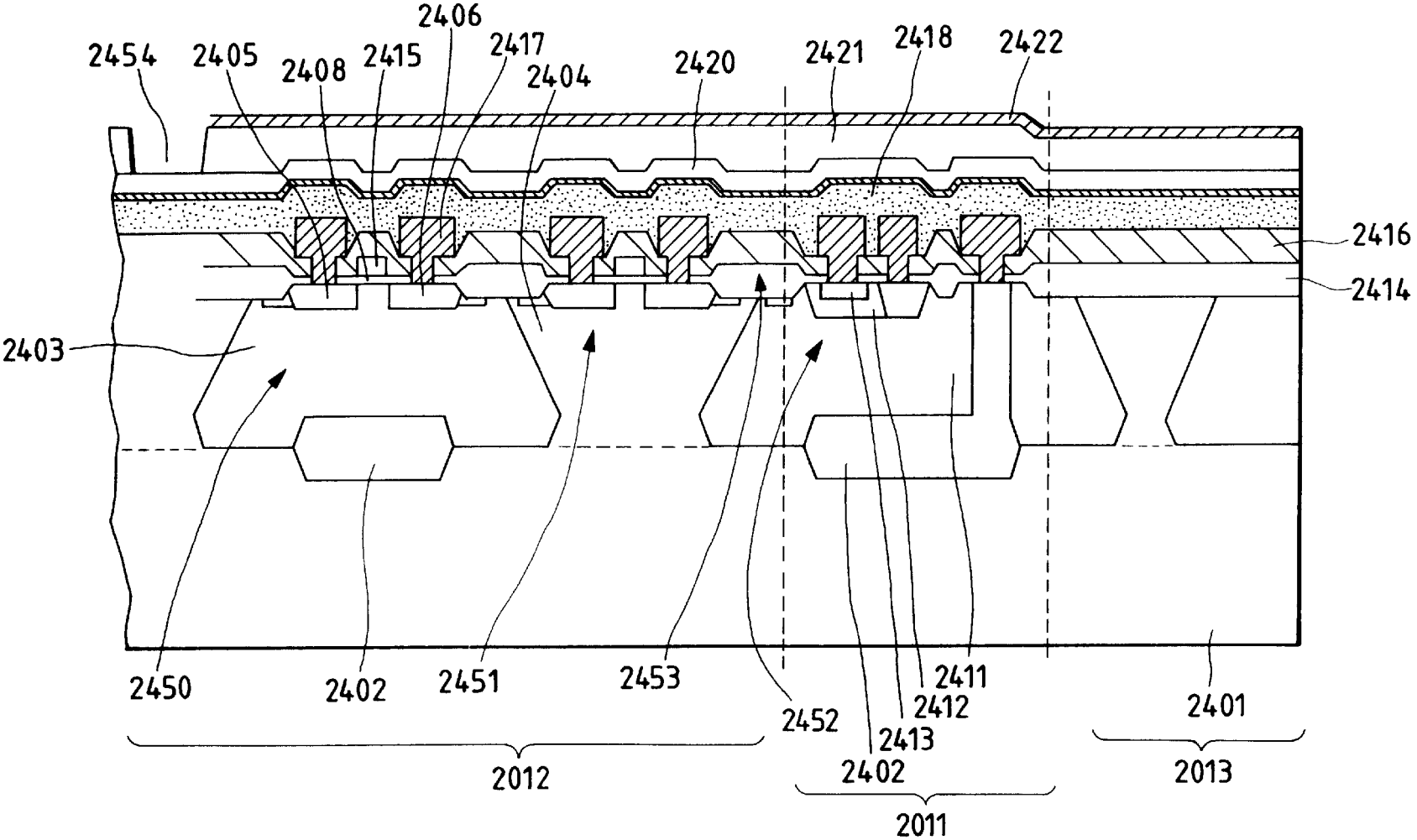
FIG. 4 is a detailed cross-sectional view, at the electrical connection side, of the substrate for the ink jet recording head shown in FIG. 2.

FIG. 3 is a detailed cross-sectional view, at the ink discharging side, of the substrate for the ink jet recording head shown in FIG. 2, and FIG. 4 is a detailed cross-sectional view, at the electrical connection side, of the substrate for the ink jet recording head shown in FIG. 2.

At first, a P-type Si base member 2401 is subjected to the introduction of a dopant such as As by ion implantation and diffusion to form an N-type buried layer 2402, and then, an N-type epitaxial layer 2403 of a thickness of 5 μm to 10 μm is formed on the N-type buried layer 2402.

Then, an impurity such as B is introduced into the epitaxial layer 2403 to form a P-type well region 2404.

Subsequently, P-MOS 2450 and N-MOS 2451 are respectively formed in the N-type epitaxial layer 2403 and in the P-type well region 2404, by repeating the photolithographic process, oxidative diffusion and impurity introduction such as ion implantation. Each of P-MOS 2450 and N-MOS 2451 has a gate wiring 2415 of polysilicon with a thickness of 4000 Å to 5000 Å deposited by CVD on a gate insulating film 2408 of a thickness of several hundred Angstroms, and a source region 2405 and a drain region 2406 formed by N- or P-type impurity introduction.

Then, an interlayer insulation film 2418 is deposited by plasma CVD with a thickness of 0.3 μm to 2.0 μm, and a resistance layer 2419 consisting of a TaN film with a thickness of about 0.001 μm to 0.3 μm and wirings consisting of an Al film with a thickness of 0.1 μm to 2 μm are successively formed in through-holes (not shown) by DC sputtering.

Then, a protective film 2421 consisting of an SiN film is formed with a thickness of 0.1 μm to 2 μm, by a two-step film formation with plasma CVD at 200° C. to 300° C. and at 350° C. to 400° C.

Then, as an uppermost layer, an anticavitation film 2422 composed of Ta is deposited with a thickness of 2300 Å, and a pad portion 2454 is opened.

Then, an annealing step is applied in an $H_2$ atmosphere of about 400° C. to complete the substrate for the ink jet recording head.

The above-mentioned annealing step improves the contact between Al and Si base member, and achieves restoration of the damage induced in the devices by various heat treatment steps and plasma processing steps.

The polysilicon used for the gate wiring 2415 is also provided under the heater portion, as the preheating heater 2005 shown in FIG. 2.

An NPN transistor 2452 constituting a power transistor is composed of a collector region 2411, a base region 2412 and an emitter region 2413, formed by the steps of impurity introduction, diffusion, etc. in the N-type epitaxial layer 2403.

These elements are mutually isolated by an oxide film isolation region 2453 consisting of a field oxide film of a thickness of 5000 Å to 10000 Å. This field oxide film functions, under a heat actuating portion 2455, as a first heat-accumulating layer 2414.

After the formation of the elements, an interlayer insulation film 2416 consisting, for example, of PSG or BPSG is deposited by CVD with a thickness of about 7000 Å, and, after carrying out a thermal flattening treatment, wirings are formed by a first Al electrode 2417 through contact holes.

Third Embodiment

Figure 5:
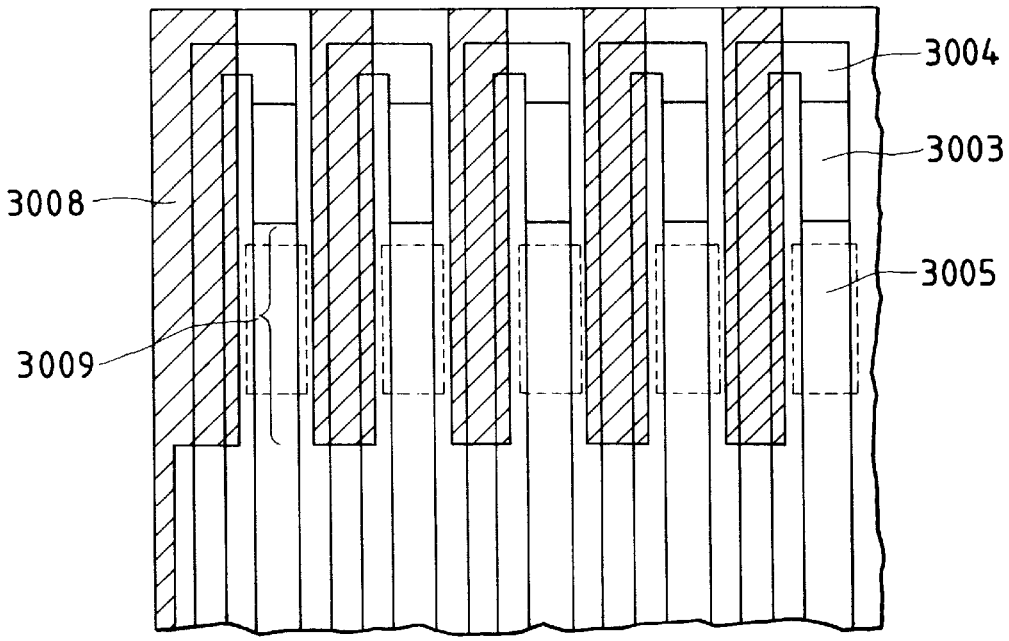
FIG. 5 is a plan view showing a third embodiment of the substrate of the present invention for the ink jet recording head.

FIG. 5 is a view showing a third embodiment of the substrate of the present invention for the ink jet recording head.

In the present embodiment, as shown in FIG. 5, there are provided a plurality of bubble-generating heaters 3003 composed of heat-generating resistance members (not shown) for generating heat required for bubble generation in the ink, wirings 3004 for supplying electrical current from the power source (not shown) to the heat-generating resistance members, and a plurality of preheating heaters 3005 each provided corresponding to the bubble-generating heater 3003 and composed of heat-generating resistance members for generating heat required for performing the temperature adjustment and the discharge adjustment of the recording head portion, and ink flow paths 3009 for supplying the ink to the recording head portion are provided above the portion of the preheating heaters 3005. Also, nozzle walls 3008 are provided on the underlying layer of the wirings 3004 with interposition of an insulating film (not shown).

In the substrate of the above-explained configuration for the ink jet recording head, since the preheating heaters 3005 are provided at a portion lower than that of the ink flow paths 3009, the ink contained in the ink flow paths 3009 is heated by the bubble-generating heaters 3003 and the preheating heaters 3005 so that the frequency characteristics of the ink refilling can be improved.

Fourth Embodiment

Figure 6:
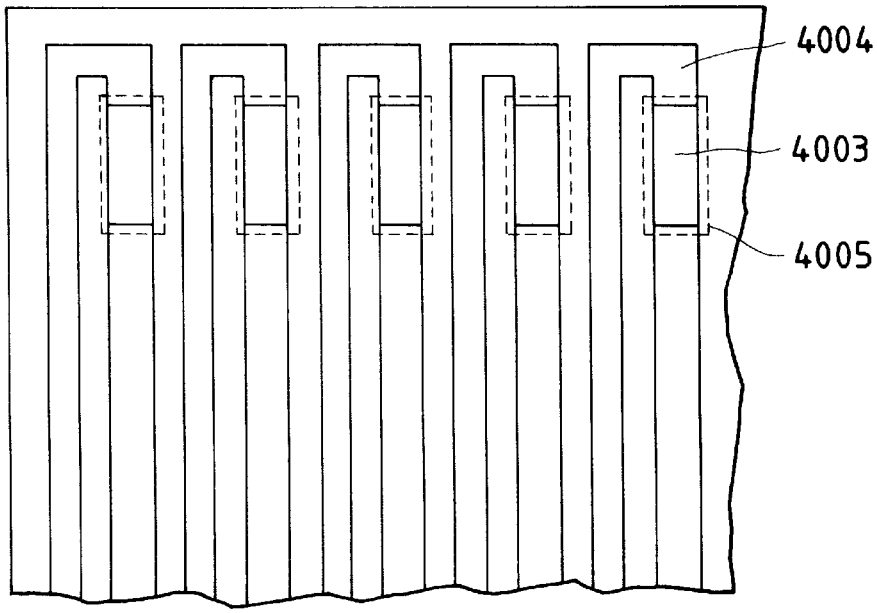
FIG. 6 is a plan view showing a fourth embodiment of the substrate of the present invention for the ink jet recording head.

FIG. 6 is a view showing a fourth embodiment of the substrate of the present invention for the ink jet recording head.

In the present embodiment, as shown in FIG. 6, there are provided a plurality of bubble-generating heaters 4003 composed of heat-generating resistance members (not shown) for generating heat required for bubble generation in the ink, wirings 4004 for supplying electrical current from the power source (not shown) to the heat-generating resistance members, and a plurality of preheating heaters 4005 composed of heat-generating resistance members provided respectively corresponding to the bubble-generating heaters 4003 and serving for generating heat for performing for the temperature adjustment and the discharge adjustment of the recording head portion. The preheating heaters 4005 are provided in portions of the bubble-generating heaters 4003 with interposition of an insulating film (not shown).

In the substrate of the above-explained configuration for the ink jet recording head, since the preheating heaters 4005 and the bubble-generating heaters 4003 are provided in same portions with interposition of the insulating film, uniformity of heating the ink can be improved prior to the bubble generation therein.

Fifth Embodiment

Figure 7:
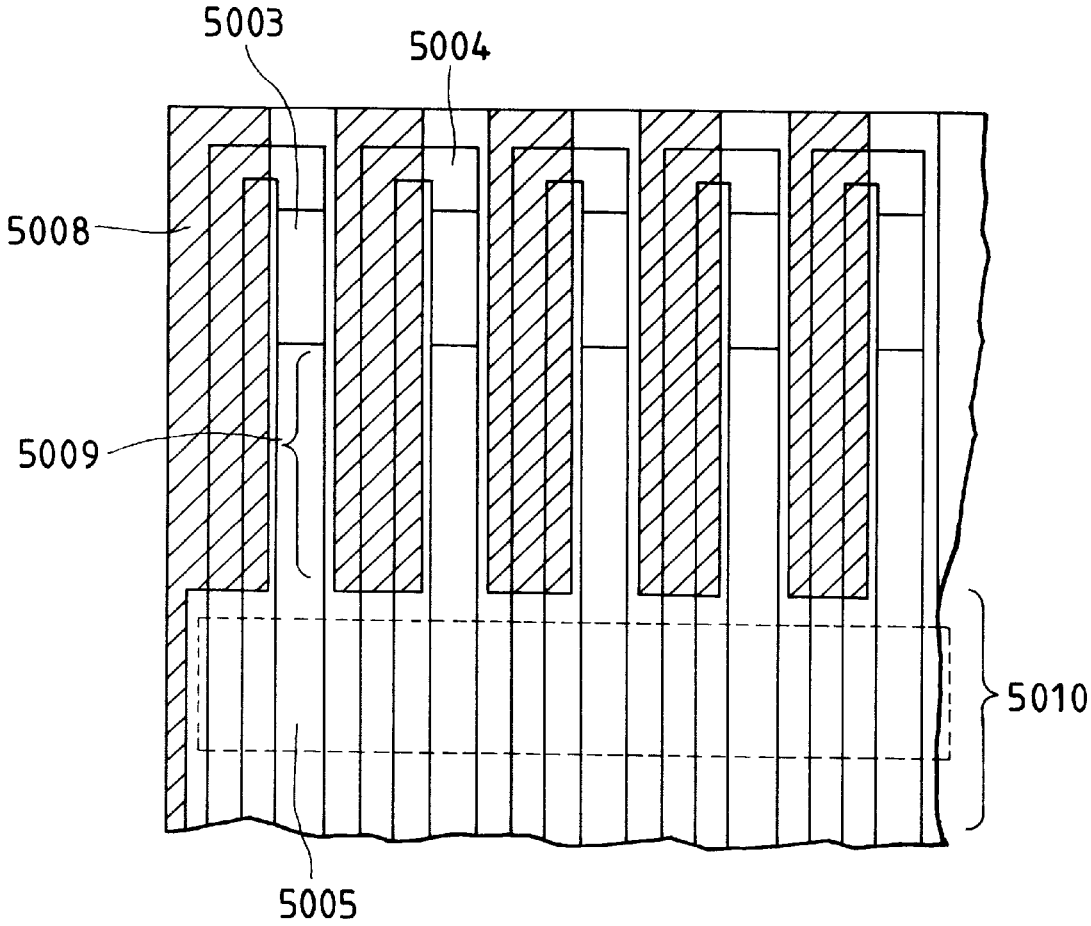
FIG. 7 is a plan view showing a fifth embodiment of the substrate of the present invention for the ink jet recording head.

FIG. 7 is a view showing a fifth embodiment of the substrate of the present invention for the ink jet recording head.

In the present embodiment, as shown in FIG. 7, there are provided a plurality of bubble-generating heaters 5003 composed of heat-generating resistance members (not shown) for generating heat required for bubble generation in the ink, wirings 5004 for supplying electrical current from the power source (not shown) to the heat-generating resistance members, and a plurality of preheating heaters 5005 composed of heat-generating resistance members for generating heat for performing the temperature adjustment and the discharge adjustment of the recording head portion, and a common liquid chamber 5010 is provided on the portion of the preheating heaters 5005, the chamber containing the ink to be supplied to the recording head portion. Ink flow paths 5009 are formed on the portions respectively between the preheating heaters 5005 and the bubble-generating heaters 5003, and also nozzle walls 5008 are formed on an underlying layer of the wirings 5004 with interposition of an insulating film (not shown).

In the substrate of the above-explained configuration for the ink jet recording head, since the preheating heaters 5005 are provided at the portion of the common liquid chamber 5010, the ink contained in the common liquid chamber 5010 is heated prior to the bubble generation, so that the temperature characteristics can be improved.

In the following, there will be explained an ink jet recording head comprising the above-explained substrate, and an ink jet recording apparatus equipped with such ink jet recording head.

Figure 8:
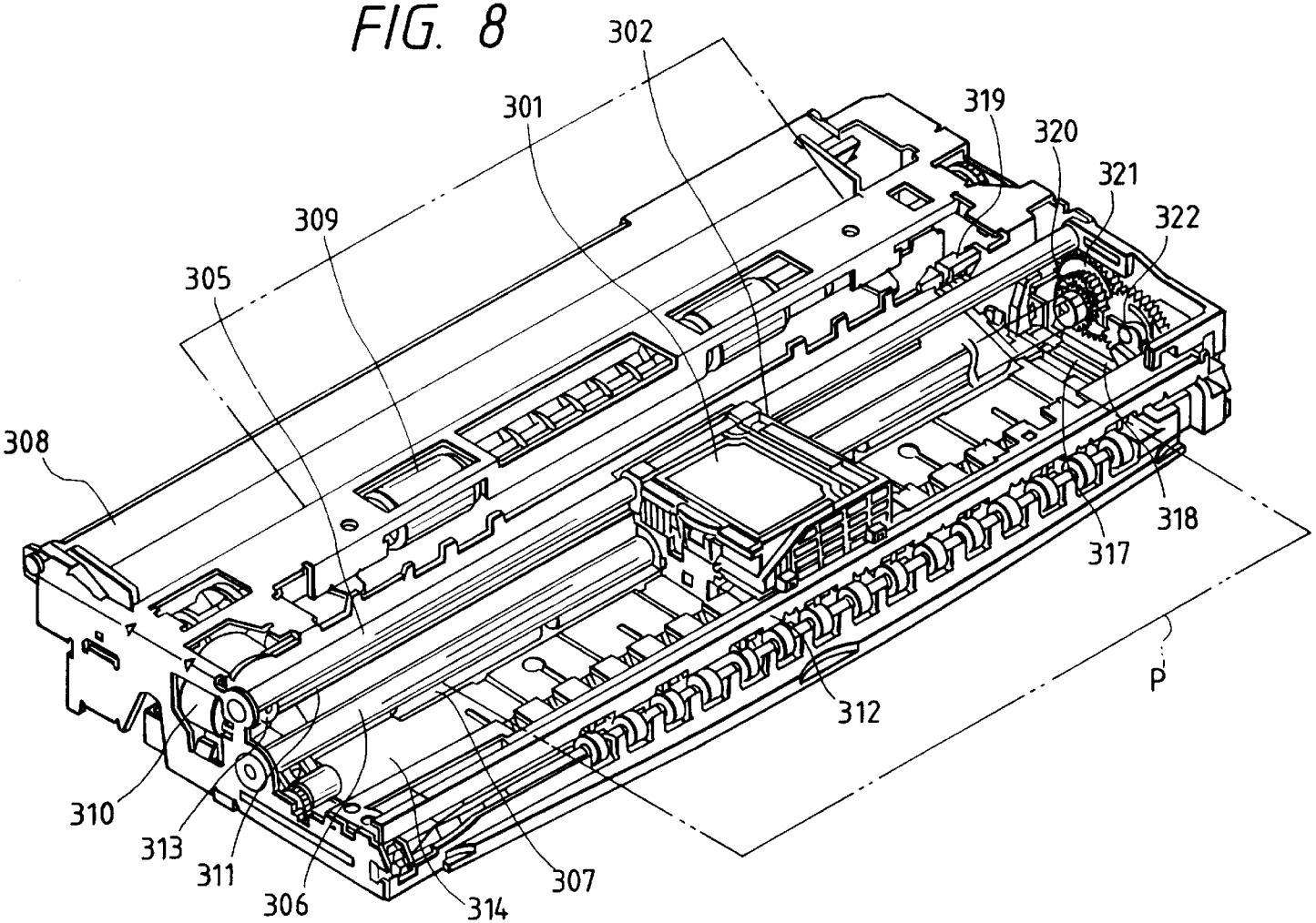
FIG. 8 is a view showing an embodiment of the ink jet recording apparatus provided with an ink jet recording head comprising the substrate of the present invention for the ink jet recording head.
Figure 9:
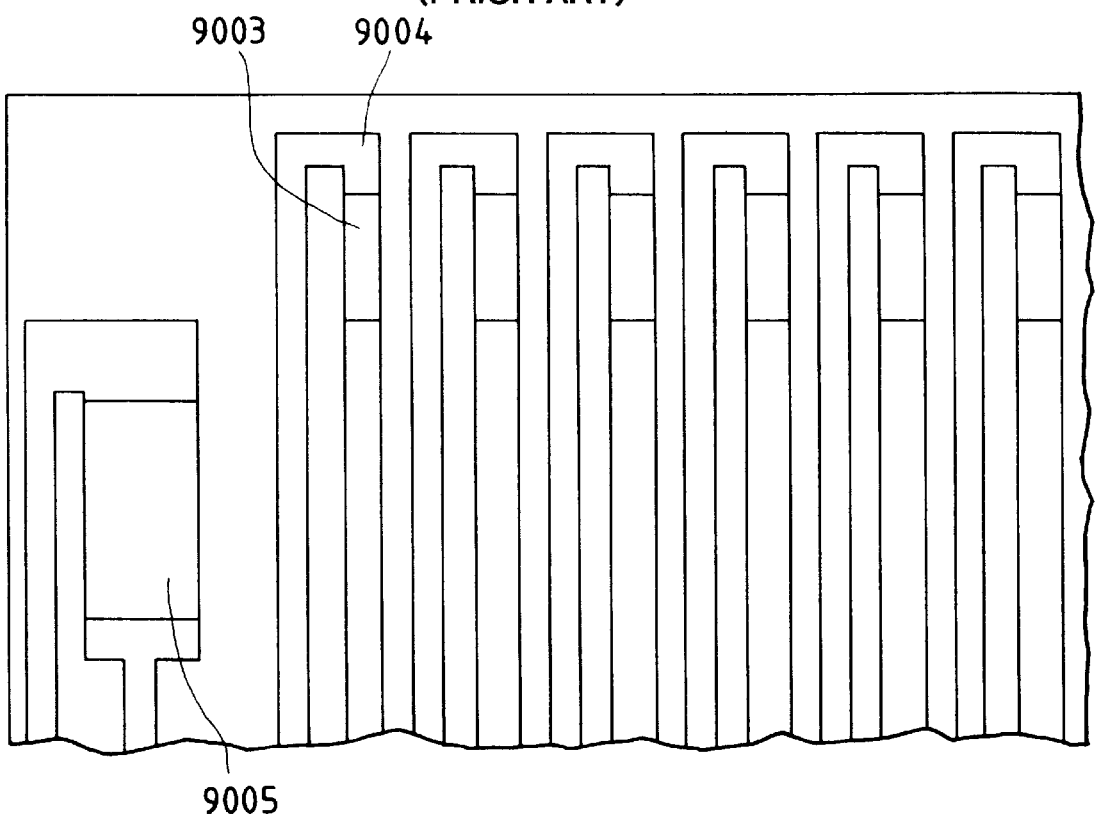
FIG. 9 (PRIOR ART)
FIG. 9 is a plan view showing an example of the conventional substrate comprising a preheating heater.

FIG. 8 is a view showing an embodiment of the ink jet recording apparatus employing the ink jet recording head comprising the substrate of the present invention for the ink jet recording head.

The ink jet recording apparatus shown in FIG. 8 is provided at least with a pick-up roller 309, a transport roller 306 and a pinch roller 307 for feeding a recording medium P which constitutes a recording material; an ink jet recording head 301 comprising a substrate for an ink jet recording head (not shown) and constituting recording means for recording on the recording medium P; a carriage 302 mounting the ink jet recording head 301; a guide shaft 305 and a guide rail 312 for supporting the carriage 302 in slidable manner perpendicularly to the transporting direction of the recording medium P but parallel to the plane thereof; a carriage driving belt 311, a carriage driving motor 310 and a driving pulley 313 for linearly reciprocating the carriage 302; a home position sensor 319 for controlling the stop position of the carriage 302; a pressure plate 308; and a base 314.

Outside the recording zone, there are provided a wiper 318 and a cap 317 for cleaning and capping of the ink jet recording head 301. At an end of the transport roller 306, there is provided an LF gear 321 for transmitting the power of the transport motor (not shown) to the transport roller 306, and there are also provided a clutch gear 320 and a pump gear 322 for transmitting the power of the LF gear 321 to the cap 317.

In the above-explained configuration, with the rotation of the pick-up roller 309 and the transport roller 306, the recording medium P is pulled in and transported to a position opposed to the ink discharging face of the ink jet recording head 301. Then, the activation of the carriage driving motor 310 rotates the carriage driving belt 311, whereby the carriage 302 is linearly reciprocated along the guide shaft 305 and the guide rail 312. At the same time the ink jet recording head 301 mounted on the carriage 302 discharges ink according to the recording signals, thereby effecting desired recording on the recording medium P.

The present invention, having the configuration explained in the foregoing, provides the following advantages.

In the substrate of the present invention for use in the ink jet recording head as described above, since the preheating heater is provided in a layer lower than that of the bubble-generating heater with interposition of an insulating film, the position of such preheating heater is not limited by the arrangement of the bubble-generating heater or of the wirings connecting thereto, so that the preheating heater can be positioned close to the bubble-generating heater and therefore the size of the substrate can be made smaller.

It is therefore rendered possible to improve the efficiency of preheating of the recording head, and to reduce the manufacturing cost.

In a preferred embodiment of the substrate of the present invention as described above, the preheating heater is formed by using a resistance member different in resistive material from that for the bubble-generating heater, the bubble-generating heater can be formed from a resistance member having a sufficient energy per unit area for causing bubble generation in the ink, while the preheating heater can be formed from a resistance member having an energy per unit area not causing unnecessary bubble generation in the ink.

It is therefore rendered possible to arbitrarily adjust the size of the preheating heater according to the requirement, and to improve the discharge efficiency of the ink.

In another preferred embodiment of the substrate of the present invention as described above, since the preheating heater is formed by using polysilicon which is employed in the formation of integrated circuits, the manufacture can be achieved without increasing the number of layers or steps.

In the substrate of the present invention as described above, since the preheating heater is provided in a position corresponding to the ink flow path, there can be achieved an improvement in the frequency characteristics of the ink refilling in combination with a higher density and a larger number of the bubble-generating heaters, whereby the print can be obtained with higher quality or with a number of density levels.

In the substrate of the present invention as described above, since the preheating heater is provided in a position corresponding to the common liquid chamber, the temperature characteristics of the ink can be improved.

What is claimed is:

1. A substrate for use in an ink jet recording head comprising:

a base member:

an insulating film comprising an insulating material;

a bubble generating beater arranged in association with a corresponding ink-flow channel for causing bubble generation in ink flowing through said ink flow channel, said bubble-generating heater being formed from a resistive material;

a non bubble-generating preheating heater also arranged in association with said ink flow channel for generating heat for preheating ink in said recording head without causing bubble generation in the ink, said preheating heater being formed of a resistive material capable of generating heat to be applied to said recording head for preheating ink in said recording head without causing bubble generation in the ink;

said preheating heater being located upstream of said bubble generating heater along said flow path through which ink flows in a given direction through said ink flow channel over said substrate, said preheating heater being provided in a layer lower than that of said bubble-generating heater with interposition of said insulating film, and said preheating heater being constructed to preheat ink in said flow channel by an amount insufficient to cause bubble generation but sufficient to improve the frequency characteristics of ink refilling; and said insulating layer being formed on said substrate over said preheating heater, said bubble-generating heater and a wiring layer being formed on and in contact with said insulating film, said wiring layer being formed in a predetermined pattern of wiring to supply electrical power to said bubble-generating heater, and said wiring in said wiring layer being electrically connected through said insulating film to said preheating layer.

2. The substrate according to claim 1, wherein said preheating heater is formed by using a resistance member different in resistive material from that of said bubble-generating heater.

3. The substrate according to claim 2, wherein said preheating heater is formed by using polysilicon.

4. The substrate according to claim 1, wherein said preheating heater is formed by using polysilicon.

5. A substrate according to claim 1 and further including:

means for supplying the ink to said ink flow channel in a layer lower than that of said bubble-generating heater with interposition of said insulating film.

6. A substrate according to claim 1 and further including:

a common liquid chamber for containing the ink to be supplied to the recording head.

7. A substrate for use in an ink jet recording head, comprising on a base member:

an insulating film comprising an insulating material;

a bubble-generating heater arranged in association with a corresponding ink flow channel for generating heat sufficient to cause bubble generation in ink flowing through said ink flow channel, said bubble-generating heater being formed from a resistive material;

a non bubble-generating preheating heater, also arranged in association with said ink flow channel for preheating ink in said recording head without causing bubble generation in the ink, said preheating heater being formed of a resistive material, said preheating heater being located upstream of said bubble-generating heater along said flow path through which ink flows in a given direction through said ink flow channel over said substrate and said preheating heater being constructed to preheat ink in said flow channel by an amount insufficient to cause bubble-generation but sufficient to improve the frequency characteristics of ink refilling;

said insulating layer being formed on said substrate over said preheating heater, said bubble-generating heater and a wiring layer being formed on and in contact with said insulating film, said wiring layer being formed in a predetermined pattern of wiring to supply electrical power to said bubble-generating heater, said wiring in said wiring layer being electrically connected through said insulating film to said preheating layer; and a transistor portion and a logic portion for controlling a function of the recording head;

wherein said preheating heater is provided in a position different from that of said transistor portion and said logic portion.

8. The substrate according to claim 7, wherein said preheating heater is provided between said transistor portion and where said bubble-generating heater, and provided in a layer lower than that of said bubble-generating heater with interposition of said insulating film.

9. A combination comprising a carriage which is mounted to scan over a recording medium and an ink jet recording head including a substrate according to any one of claims 1 to 6, said ink jet recording head being mounted on said carriage.

* * * * *

UNITED STATES PATENT AND TRADEMARK OFFICE

CERTIFICATE OF CORRECTION

PATENT NO. : 6,315,396 B1 
DATED : November 13, 2001
INVENTOR(S) : Tero Ozaki et al.

It is certified that error appears in the above-identified patent and that said Letters Patent is hereby corrected as shown below:

Title page,
Item [56], References Cited, FOREIGN PATENT DOCUMENTS
"3343254" should read -- 3-043254 --.

Column 2,
Line 14, "bubblegenerating" should read -- bubble-generating --;
Line 42, "member" should read -- member: --;
Line 55, "In" should read -- ¶ said --; and
Line 60, "member" should read -- member: --.

Column 3,
Line 16, "member" should read -- member: --.

Column 5,
Line 8, "$Al_2O_3$," should read -- $Al_2O_3$, --;
Line 17, "$Al_2O_3$," should read -- $Al_2O_3$ --;
Line 43, "SiO2," should read-- $SiO_2$, --; and
Line 63, "ith" should read -- with --.

Column 6,
Line 38, "an-insulating" should read -- an insulating --.

Column 10,
Line 16, "a" should read -- on a --;
Line 18, "beater" should read -- heater --;
Line 22, "material;" should read -- material; and --;
Line 31, "ink;" should read -- ink, --; and
Line 42, "refilling; and" should read -- refilling, --

Column 11,
Line 12, "said" should read -- ¶ said --.

UNITED STATES PATENT AND TRADEMARK OFFICE

CERTIFICATE OF CORRECTION

PATENT NO. : 6,315,396 B1
DATED : November 13, 2001
INVENTOR(S) : Tero Ozaki et al.

It is certified that error appears in the above-identified patent and that said Letters Patent is hereby corrected as shown below:

Column 12,
Line 8, "head;" should read -- head, --.

Signed and Sealed this

Fifteenth Day of April, 2003

JAMES E. ROGAN
*Director of the United States Patent and Trademark Office*